United States Patent [19]

Hanneton et al.

[11] Patent Number: 4,796,685

[45] Date of Patent: Jan. 10, 1989

[54] VIBRATING TABLE FOR FORMING SAND MOLDS

[75] Inventors: Jean-Jacques Hanneton, Nogent le Roi; Michel Sivori, Les-Clayes-Sous-Bois, both of France

[73] Assignee: Regie Nationale des Usines Renault, Boulogne-Billancourt, France

[21] Appl. No.: 921,408

[22] Filed: Oct. 22, 1986

[30] Foreign Application Priority Data

Oct. 29, 1985 [FR] France ..... 85 16028

[51] Int. Cl.[4] ..... B28B 1/08; B22C 15/10

[52] U.S. Cl. ..... 164/203; 425/456

[58] Field of Search ..... 164/203, 206, 189; 210/388, 433.1; 425/456, 421, 175, 456; 209/699, 366.5, 367, 920; 366/111

[56] References Cited

U.S. PATENT DOCUMENTS

| | | | |
|---|---|---|---|
| 3,274,660 | 9/1966 | Mizer et al. | 264/69 |
| 3,767,168 | 10/1973 | Dupre et al. | 164/203 |
| 4,340,469 | 7/1982 | Archer | 209/367 |

FOREIGN PATENT DOCUMENTS

| | | |
|---|---|---|
| 967437 | 3/1950 | France . |
| 1291621 | 3/1962 | France . |
| 2088762 | 6/1982 | United Kingdom . |

OTHER PUBLICATIONS

Marks Handbook, McGraw-Hill, N.Y. (1978) pp. 570-571.

*Primary Examiner*—Willard E. Hoag

*Attorney, Agent, or Firm*—Oblon, Fisher, Spivak, McClelland & Maier

[57] ABSTRACT

Vibrating table used particularly in founding, of the type having vibrators fastened to a horizontal plate mounted on a frame and insulated from the base of this frame by elastic damping devices has two rotary vibrators having axes defining unbalance centers in planes (B, B') located parallel to the vertical plane of reference (P) of the plate which passes through its central axis (X), on the one hand, and symmetrically with this central axis, on the other hand.

2 Claims, 1 Drawing Sheet

VIBRATING TABLE FOR FORMING SAND MOLDS

BACKGROUND OF THE INVENTION

Field of the Invention

This invention relates to a vibrating table and method used particularly in founding to obtain rigid molds by compacting of sand.

It applies particularly to the molding processes in which the consumable expanded polystyrene patterns are packed in a single silica sand.

To make the corresponding molds, a good distribution of the sand around and in the interstices of these patterns, and a good packing of the sand prove essential.

The patterns which are very fragile, must not undergo any deformation or be damaged.

SUMMARY OF THE INVENTION

The invention has as its object to avoid such risks by an appropriate use of vibrations, while suitably and simultaneously assuring the filling and compacting operations of the sand.

For this purpose, it includes a vibrating table of the type comprising rotary vibrators fastened to a horizontal plate supported by a horizontal frame and insulated from the base of the frame by elastic damping devices.

According to an essential feature, this vibrating table has two vibrators whose vibrational axes define unbalance centers in planes arranged parallel to the vertical plane of reference of the plate, which passes through its central axis, and symmetrical with this central axis.

According to the method of the invention, the offset of these planes in relation to this vertical plane of reference is used as a regulating parameter for the packing (rigidity of the mold) and the distribution (filling) of the sand, without any deformation of the pattern.

These features show that it is possible, by simultaneous operation of these two vibrators, to obtain a bidirectional vibration, especially well suited to the distribution and packing of the sand.

BRIEF DESCRIPTION OF THE DRAWINGS

Other features and advantages of the invention will appear more clearly on reading the following description of a preferred embodiment, given by way of nonlimiting example, with reference to the accompanying drawings in which.

DETAILED DESCRIPTION OF THE PREFERRED EMBODIMENTS

Figure 1:
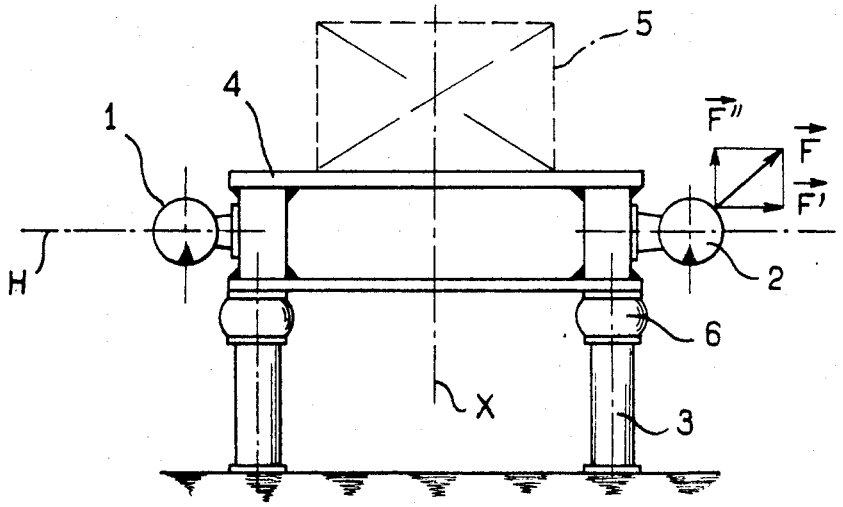
FIG. 1 is a diagrammatic elevation view of a vibrating table according to the invention.
Figure 2:
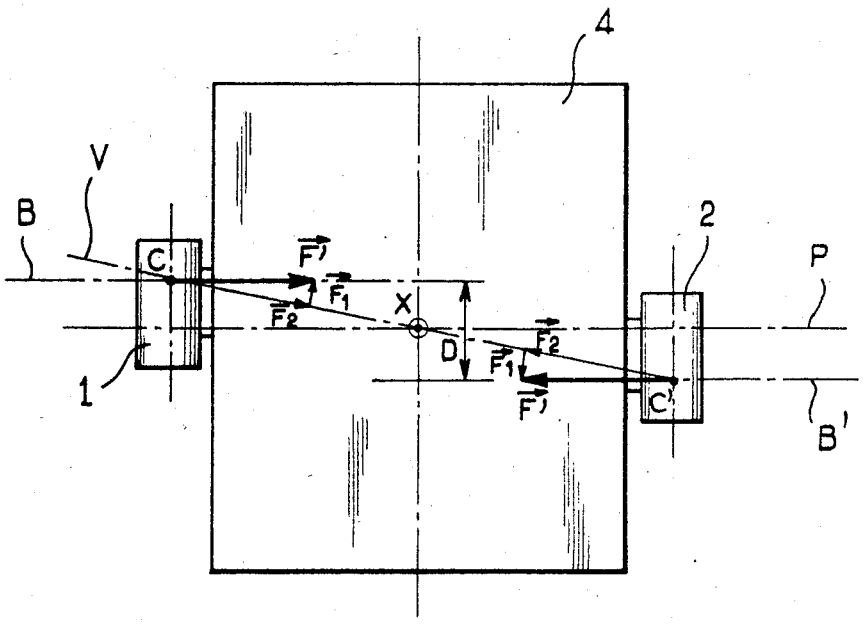
FIG. 2 is a diagrammatic plan view of this vibrating table.

According to FIGS. 1 and 2, this vibrating table has two rotary vibrators 1, 2 solidly fastened to a horizontal plate 4. The horizontal plate 4 is supported by a rigid frame 3 and is designed to receive a mold 5 to be made.

This plate 4 is insulated from frame 3 by sufficiently dimensioned elastic damping devices 6.

As FIG. 1 shows, vibrators 1, 2 are located are at precisely the same level defined by a horizontal plane H. They have unbalance rotors rotating about rotational axes having unbalance centers, C, C′ in planes B, B′ (FIG. 2) spaced from and extending parallel to the vertical plane P of plate 4 which passes through central vertical axis (X) of this plate, on the one hand, and symmetrical to this central axis, on the other hand, by rotating about horizontal axes perpendicular to planes P and B, B′.

Offset D of the planes B, B′ may be used as a regulating parameter for the packing and distribution of the sand, which is defined as a function of the part to be molded, as is the direction of rotation of vibrators 1,2.

The possibilities for controlling the system are numerous with electric vibrators and a frequency variator.

The power of the corresponding motors is set in proportion to the load to be vibrated.

Support plate 4 of mold 5 is equipped with a flanging or fixing device for the mold, not shown, whose characteristics depend on the shape and dimensions of this mold.

Elastic damping devices 6 can be mechanical (springs) or pneumatic (tires).

Shown in FIG. 1 are centrifugal forces F which are exerted on respective vibrators 1, 2 turning in opposite directions with an average offset D.

These centrifugal forces F are located in the vertical planes B, B′ parallel to plane P.

They are broken down into a horizontal component F′ and a vertical component F″.

Since the vibrators operate in synchronism, vertical components F″ are added and determine a vibratory vertical amplitude.

Each horizontal component F′ may be broken down into two other components $F_1$ and $F_2$ by projection on vertical plane V passing through central axis X and unbalance centers C, C′ (FIG. 2). The two components $F_2$ in this plane cancel one another. The two components $F_1$ not contained in this plane V form a horizontal vibrational pair having an amplitude proportional to the offset D.

This breakdown of forces being exerted on this vibrating table assumes the following material conditions:

1. The two vibrators, 1 2 are fixed to the same support;
2. Plate 4 is made rigid by reinforcements to prevent any deformation from the vibration;
3. Plate 4 is insulated from frame 3 (framework) by elastic damping devices.

The above-described vibrating table thus makes it co adapt the vibration to the type of part to be produced, by causing only offset D of vibrators 1, 2 to vary.

Obviously, numerous modifications and variations of the present invention are possible in light of the above teachings. It is therefore to be understood that within the scope of the appended claims, the invention may be practiced otherwise than as specifically described herein.

We claim:

1. A vibrating table for compacting sand in a rigid foundary mold, comprising:

a stationary frame;

a horizontal plane having a central vertical axis, said horizontal plate comprising means for fixedly supporting a foundary mold directly on said plate;

elastic damping means for supporting said horizontal plate on said frame; and two rotary vibrators fixed directly to said horizontal plate, said vibrators having unbalance rotors defining unbalance axes of rotation extending perpendicular to a vertical reference plane passing through said central vertical axis, said rotors each defining an unbalance center on a respective one of said unbalance axes, said centers each lying in a plane perpendicular to said vertical reference plane and in which centrifugal forces derived form the rotation of said unbalance rotors extend, said unbalance centers being offset and mutually symmetrical with respect to said central vertical axis, said vibrators also having means for operating said vibrational means in synchronism and in opposite directions.

2. The vibrating table of claim 1 including a rigid foundary mold supported by said means for fixedly supporting a foundary mold.

* * * * *